US008400486B2

(12) United States Patent
Shinohara

(10) Patent No.: US 8,400,486 B2
(45) Date of Patent: Mar. 19, 2013

(54) THERMAL TRANSFER SHEET, TRANSFERRED IMAGE RECEIVING SHEET, AND THERMAL TRANSFER METHOD

(75) Inventor: Satoru Shinohara, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 13/243,798

(22) Filed: Sep. 23, 2011

(65) Prior Publication Data

US 2012/0013698 A1 Jan. 19, 2012

(30) Foreign Application Priority Data

Nov. 5, 2010 (JP) ..... P2010-248830

(51) Int. Cl.
*B41J 2/315* (2006.01)
*B41J 17/30* (2006.01)
*B41M 5/40* (2006.01)

(52) U.S. Cl. ..... 347/217; 347/221; 428/32.77

(58) Field of Classification Search ..... 347/215, 347/217, 221, 171; 428/32.39, 32.6, 32.75, 428/32.77; 503/209
See application file for complete search history.

(56) References Cited

U.S. PATENT DOCUMENTS

| | | | | |
|---|---|---|---|---|
| 4,929,591 | A | 5/1990 | Egashira et al. | |
| 7,123,280 | B2 * | 10/2006 | Koyama et al. | 347/221 |
| 2005/0264644 | A1 * | 12/2005 | Natsui et al. | 347/221 |
| 2006/0125909 | A1 * | 6/2006 | Hamada et al. | 347/221 |
| 2009/0181190 | A1 * | 7/2009 | Tsubaki | 428/32.77 |
| 2011/0045213 | A1 * | 2/2011 | Ieshige et al. | 428/32.6 |

FOREIGN PATENT DOCUMENTS

| | | |
|---|---|---|
| JP | 62-26319 | 6/1987 |
| JP | 5-36779 | 5/1993 |
| JP | 2714659 | 11/1997 |

* cited by examiner

*Primary Examiner* — Kristal Feggins
(74) *Attorney, Agent, or Firm* — Frommer Lawrence & Haug LLP; William S. Frommer

(57) ABSTRACT

Disclosed herein is a thermal transfer sheet including: a dye layer which is provided on one side of a substrate and which contains an indoaniline dye; and a transferred image coating layer provided on that side of the substrate on which the dye layer is formed, the transferred image coating layer being operable to coat an image thermally transferred onto a transferred image receiving sheet, wherein the transferred image coating layer contains a compound having a predetermined structure and a binder resin, and the content of the compound having the predetermined structure is 0.5 to 8 parts by mass based on 100 parts by mass of the binder resin.

9 Claims, 2 Drawing Sheets

THERMAL TRANSFER SHEET, TRANSFERRED IMAGE RECEIVING SHEET, AND THERMAL TRANSFER METHOD

BACKGROUND

The present technology relates to a thermal transfer sheet, a transferred image receiving sheet, and a thermal transfer method.

In recent years, in place of silver salt type photography, a photo kiosk and the like in which a photographic image is selected by a computer used as a terminal equipment and an image of the selected photograph is outputted by a printer based on a dye diffusion thermal transfer system have come to be widely installed, in view of the high immediate printing properties offered by the printer of the dye diffusion thermal transfer system. As a cyan dye in the printer of the dye diffusion thermal transfer system, indoaniline dyes are often used from the viewpoints of sensitivity, print storage stability, hue, etc.

Meanwhile, in image printing methods using an ink jet system or the above-mentioned dye diffusion thermal transfer system, it is an important requirement to maintain the quality of prints. In order to meet the requirement, a variety of methods have been proposed.

For instance, Japanese Patent Publication No. Sho 62-26319 (hereinafter referred to as Patent Document 1) describes a technology in which a phenol derivative substituted by a tertiary alkyl at at least one of the ortho-positions with respect to the hydroxyl group is contained as a dye image fading preventive agent in an ink jet printing paper, whereby light fastness of ink jet dyes is prevented from being deteriorated.

In addition, Japanese Patent Publication No. Hei 5-36779 (hereinafter referred to as Patent Document 2) describes a technology in which a specific compound is contained in a transferred image receiving element for heat-sensitive sublimatic transfer material, whereby light fastness of prints is enhanced.

Furthermore, Japanese Patent No. 2714659 (hereinafter referred to as Patent Document 3) describes a technology in which an antioxidant having a hindered phenol skeleton of a specified structure is added to a sublimatic transfer transferred image receiving sheet, whereby light fastness is enhanced.

SUMMARY

Thus, in regard of technology for maintaining the quality of printed images, a variety of methods have been investigated, as described for example in the above-mentioned Patent Documents 1 to 3. In connection with this, the present inventors made investigations on printers based on the dye diffusion thermal transfer system, to find out that the indoaniline dyes often used as cyan dye have difficulties in storage stability in dark place.

Accordingly, there is a need for a thermal transfer sheet, a transferred image receiving sheet, and a thermal transfer method which are novel and improved and by which it is possible to produce prints excellent in storage stability in dark place.

According to an embodiment of the present technology, there is provided a thermal transfer sheet including: a dye layer which is provided on one side of a substrate and which contains an indoaniline dye; and a transferred image coating layer provided on that side of the substrate on which the dye layer is formed, the transferred image coating layer being operable to coat an image thermally transferred onto a transferred image receiving sheet. In the thermal transfer sheet, the transferred image coating layer contains a compound having a predetermined structure and a binder resin, and the content of the compound having the predetermined structure is 0.5 to 8 parts by mass based on 100 parts by mass of the binder resin.

According to another embodiment of the present technology, there is provided a transferred image receiving sheet including: a receiving layer to which an indoaniline dye is to be thermally transferred. In the transferred image receiving sheet, the receiving layer contains a compound having a predetermined structure and a binder resin, and the content of the compound having the predetermined structure is 0.5 to 8 parts by mass based on 100 parts by mass of the binder resin.

Here, the above-mentioned compound having the predetermined structure may be one or a plurality of compounds represented by the following structural formula (1) or (2):

(1)

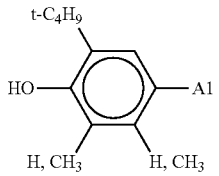

where A1 is an alkyl group substituted by at least one of a substituent group containing carboxylic acid ester and ether, an aryl and a thioether, or an aryl-substituted thiol group;

(2)

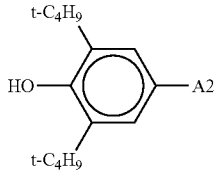

where A2 is a thioether-substituted alkyl group, a heterocyclic ring-substituted amino group, or an aryl-substituted thiol group.

More specifically, the compound having the predetermined structure may be one or a plurality of compounds represented by any of the following structural formulas (1-1) to (2-3):

(1-1)

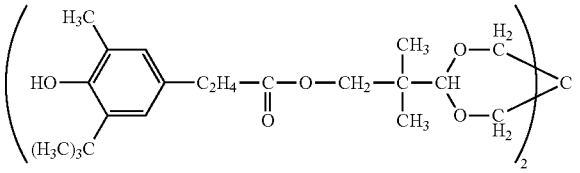

(1-2)

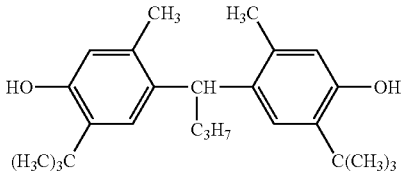

-continued (1-3)

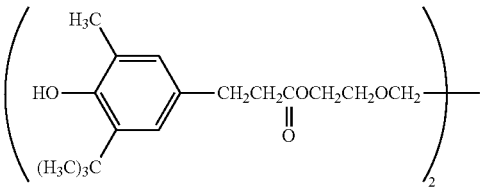

(1-4)

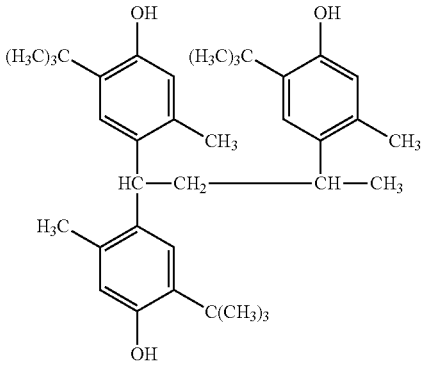

(1-5)

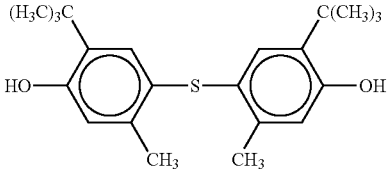

(1-6)

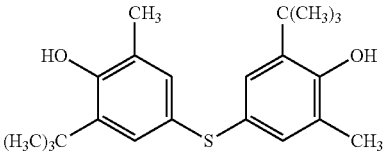

(1-7)

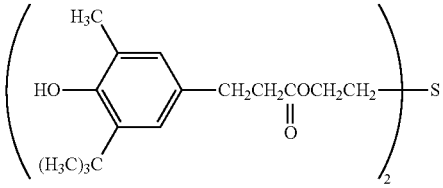

(2-1)

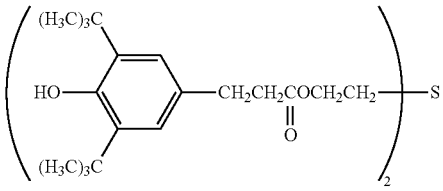

(2-2)

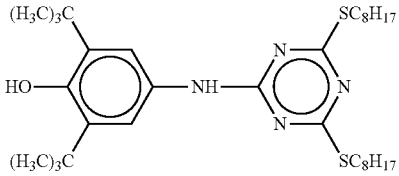

-continued (2-3)

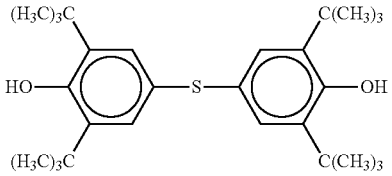

The above-mentioned indoaniline dye may be a compound represented by the following structural formula (3):

(3)

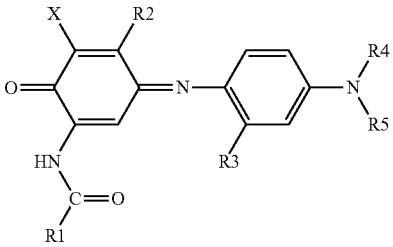

where the substituent groups R1, R2, R4 and R5 are each independently an alkyl group of one to three carbon atoms, R3 is hydrogen or an alkyl group of one to three carbon atoms, and X is hydrogen or chlorine.

According to a further embodiment of the present technology, there is provided a thermal transfer method including: thermally transferring, from a thermal transfer sheet which includes a dye layer containing an indoaniline dye and a transferred image coating layer operable to coat an image thermally transferred to a transferred image receiving sheet, the indoaniline dye to a receiving layer of the transferred image receiving sheet; and thermally transferring the transferred image coating layer onto the receiving layer to which the indoaniline dye has been thermally transferred. In the method, at least either one of the transferred image coating layer and the receiving layer contains a compound having a predetermined structure and a binder resin, and the content of the compound having the predetermined structure is 0.5 to 8 parts by mass based on 100 parts by mass of the binder resin.

According to embodiments of the present technology, as above-described, the compound having the predetermined structure is contained, in a specified quantity, at least either one of the transferred image coating layer of the thermal transfer sheet and the receiving layer of the transferred image receiving sheet. This ensures that prints which are excellent in storage stability in dark place can be produced.

DETAILED DESCRIPTION OF THE PREFERRED EMBODIMENTS

Figure 1:
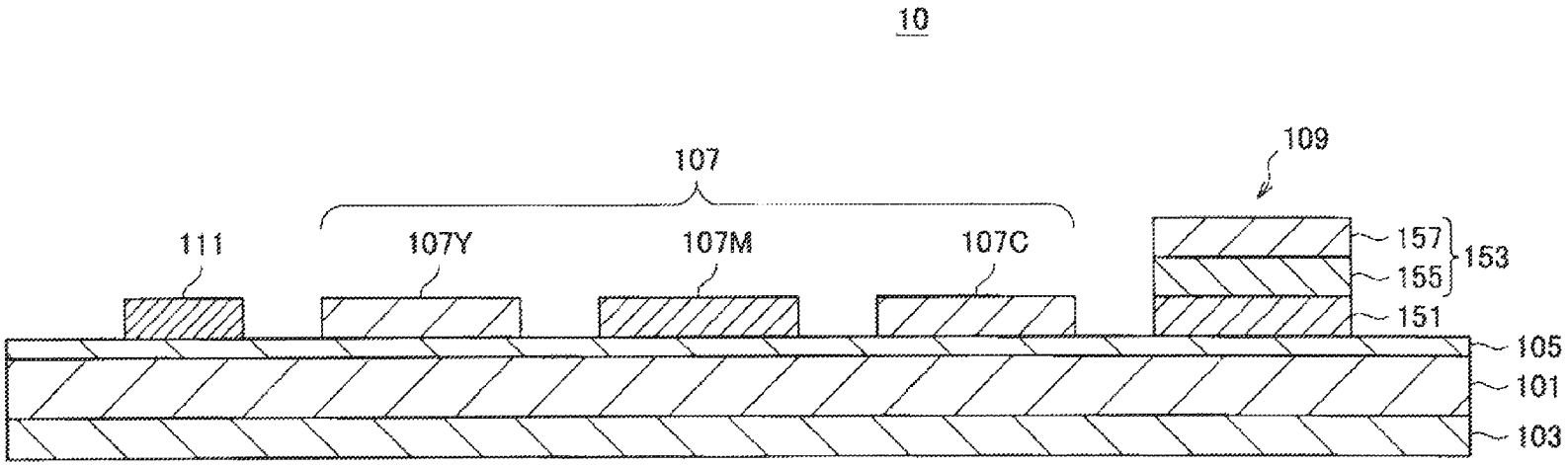
FIG. 1 is a sectional view of a thermal transfer sheet according to an embodiment of the present technology.

Now, preferred embodiments of the present technology will be described in detail below, referring to the accompanying drawings. Incidentally, in the present specification and drawings, components having substantially the same functions and/or configurations will be denoted by the same reference symbols, and repetition of the same descriptions of them will be avoided.

Besides, in the following description, the expression "parts" means parts by mass.

Incidentally, the description will be made in the following order.

(1) Investigations on Indoaniline Dyes (2) First Embodiment (2-1) Configuration of Thermal Transfer Sheet (2-2) Configuration of Transferred Image Receiving Sheet (2-3) Additive Compound (3) Examples and Comparative Examples (3-1) Production Examples of Thermal Transfer Sheet (3-2) Production Examples of Transferred Image Receiving Sheet (3-3) Printing Method (3-4) Evaluation (Investigations on Indoaniline Dyes)

In the first place, prior to descriptions of a thermal transfer sheet, a transferred image receiving sheet, and a thermal transfer method according to an embodiment of the present technology, detailed description will be made of the investigations conducted by the present inventors in regard of printers based on the dye diffusion thermal transfer system using indoaniline dyes.

In relation to the printers based on the thermal transfer system using indoaniline dyes as cyan dye, the present inventors made investigations for enhancing the sensitivity and light fastness of the dyes by controlling functional groups introduced into indoaniline dyes and the like factors. As a result of their investigations, they found out an unknown and unsolved problem that the indoaniline dyes have difficulties in storage stability in dark place.

In order to solve the dark-place storage stability problem, the present inventors made intensive and extensive investigations, which led to a finding that the dark-place storage stability can be improved by addition of a compound having a predetermined structure to a receiving layer of a transferred image receiving sheet and/or to a laminate layer of a thermal transfer sheet, in the case of performing printing by use of indoaniline dyes.

From the viewpoint of addition of a compound or compounds, the above-mentioned Patent Document 2 also describes a method in which a compound having a specific structure is added to the receiving element. Besides, the above-mentioned Patent Document 2 mentions a variety of dyes to be used particularly in heat-sensitive sublimatic transfer method. Among the dyes, azomethine dye and indoaniline dye are described to be remarkably enhanced in regard of light fastness of dye images when the compounds described in Patent Document 2 are added to the dyes.

However, the indoaniline dye on which an actual effect of the compound addition has been confirmed in Patent Document 2 is only one kind, and such a dye is different from the indoaniline dyes to be used in the embodiment of the present technology which will be described below. Besides, the compounds added for enhancing the light fastness of images in Patent Document 2 are different from the compounds used in the embodiment of the present technology described below. Furthermore, in Patent Document 2 there is no recognition of the problem of dark-place storage stability which has come to be found out by the present inventors.

In addition, there commonly exists an optimum value for the addition amount of the additive used for preventing deterioration from arising from an oxidation reaction, as described in the above-mentioned Patent Document 2. Specifically, too small an addition amount may result in no effect, and too large an addition amount may produce an adverse effect. Therefore, it is important to confirm the optimum amount of the additive to be added.

On the other hand, the above-mentioned Patent Document 3 discloses a technology in which, as above-mentioned, an antioxidant having a hindered phenol skeleton of a specified structure is added, in order to obtain an improved light fastness. However, the dye for which the effect of the addition was confirmed in Patent Document 3 is only Kayaset Blue 714 (produced by Nippon Kayaku Co., Ltd.), which is an anthraquinone dye. There is no mention made in Patent Document 3 on indoaniline dyes, which are paid attention to in the embodiment of the present technology. Besides, according to Patent Document 3, the antioxidant is added in an extremely large amount of about 10 parts by weight, based on the amount of the resin constituting the matrix.

The embodiment of the present technology as will be described below is quite different from the above-mentioned related arts.

Specifically, an embodiment of the present technology resides in that, in a thermal dye transfer system in which an image is formed on a transferred image receiving sheet by use of at least one indoaniline dye and a laminate layer is further formed, a small amount of a compound having a specific structure is added to part of a receiving layer of the transferred image receiving sheet and/or the laminate layer of a thermal transfer sheet, whereby dark-place storage stability of the indoaniline dye(s) is enhanced.

Incidentally, it should be noted that substantially no improving effect on the light fastness of images formed by use of indoaniline dyes is observed in the embodiment of the present technology described below, and that an improvement in light fastness of images and an improvement in dark-place storage stability of images are utterly different from each other.

First Embodiment

<Configuration of Thermal Transfer Sheet>

First, referring to FIG. 1, the configuration of a thermal transfer sheet 10 according to a first embodiment of the present technology will be described below.

The thermal transfer sheet 10 according to the present embodiment includes mainly a thermal transfer sheet substrate 101, a heat-resistant lubricant layer 103 formed on one side of the thermal transfer sheet substrate 101, a dye layer 107 formed on the side, opposite to the side on which the heat-resistant lubricant layer 103 is formed, of the thermal transfer sheet substrate 101, a laminate layer 109, and a sensor mark layer 111. In addition, as shown in FIG. 1, a primer layer 105 may be formed between the thermal transfer sheet substrate 101 and the dye layer 107, the laminate layer 109 and the sensor mark layer 111.

The primer layer 105 may be provided on the whole area of the side, opposite to the side of the heat-resistant lubricant layer 103, of the thermal transfer sheet substrate 101 as shown in FIG. 1, or may be provided only between the thermal transfer sheet substrate 101 and a specified layer(s). For example, a structure may be adopted in which the primer layer 105 is provided only between the thermal transfer sheet substrate 101 and both the dye layer 107 and the sensor mark layer 111, and is not provided between the thermal transfer sheet substrate 101 and the laminate layer 109.

[Thermal Transfer Sheet Substrate]

The thermal transfer sheet substrate 101 has a flat plate-like shape with a thickness of 0.5 to 50 μm, preferably 1 to 10 μm.

The resin constituting the thermal transfer sheet 101 may be any of those known resins which are used to constitute thermal transfer sheet substrates and which have certain degrees of heat resistance and strength.

Examples of such resin material include polyethylene terephthalate film, 1,4-polycyclohexylene dimethylene terephthalate film, polyethylene naphthalate film, polyphenylene sulfide film, polystyrene film, polypropylene film, polysulfone film, aramide films, polycarbonate film, polyvinyl alcohol film, cellophane, cellulose derivatives (such as cellulose acetate), polyethylene film, polyvinyl chloride film, nylon films, polyimide films, and ionomer films.

[Heat-Resistant Lubricant Layer]

The heat-resistant lubricant layer 103 is provided on one side of the thermal transfer sheet substrate 101 for the purpose of preventing bad influences of the heat from a thermal head, such as sticking or wrinkles in prints. The heat-resistant lubricant layer 103 includes a resin and a lubricity-imparting agent, possibly attended by filler which is optionally added.

The resin constituting the heat-resistant lubricant layer 103 may be any of known resins which are used to constitute heat-resistant lubricant layers. Examples of such resin include polyvinylbutyl acetal resin, polyvinyl acetoacetal resin, polyester resins, vinyl chloride-vinyl acetate copolymer, polyether resins, polybutadiene resin, styrne-butadiene copolymer, acrylpolyol, polyurethane acrylate, polyester acrylates, polyether acrylates, epoxy acrylate, urethane or epoxy prepolymer, nitrocellulose resin, cellulose nitrate resin, cellulose acetate propionate resin, cellulose acetate butyrate resin, cellulose acetate hydrogenphthalate resin, cellulose acetate resin, aromatic polyamide resins, polyimide resins, polyamide-imide resins, polycarbonate resin, and chlorinated polyolefin resins.

The lubricity-imparting agent is added to or applied to the heat-resistant lubricant layer 103. Examples of the lubricity-imparting agent include: particulates of organic matter such as higher fatty acids and their salts, higher fatty acid graft polymers, nylon fillers, etc.; particulates of inorganic matter such as graphite powder, etc.; phosphoric esters; and silicone polymers such as silicone oil, silicone graft polymers, fluoro graft polymers, acrylsilicone graft polymers, acrylsiloxane, arylsiloxanes, etc.

The heat-resistant lubricant layer 103 may be a layer including a polyol, e.g., polyalcohol polymer compound, and polyisocyanate and a phosphoric ester compound.

The heat-resistant lubricant layer 103 may be formed by the following method. First, the resin, the lubricity-imparting agent, and the optionally added filler are dissolved or dispersed in a predetermined solvent, to prepare a heat-resistant lubricant layer composition (liquid composition). Next, the composition is applied to the back side of the thermal transfer sheet substrate 101 by forming means such as a gravure printing method, a screen printing method, a reverse roll coating method using a gravure plate, etc., followed by drying. As a result, the heat-resistant lubricant layer 103 is formed. The thickness of the heat-resistant lubricant layer 103 when dried is preferably in the range of 0.1 to 3.0 g/m$^2$.

[Primer Layer]

The primer layer 105 is formed on the face side (the side opposite to the side of the heat-resistant lubricant layer 103) of the thermal transfer sheet substrate 101. The primer layer 105 is for strengthening the adhesion of the thermal transfer sheet substrate 101 to the dye layer 107, the laminate layer 109 and the sensor mark layer 111 which will be described later. The resin constituting the primer layer 105 may be any of known resins which are used to constitute primer layers. Among such resins, particularly preferred are those resins which promise strong adhesion between the thermal transfer sheet substrate 101 and the dye layer 107, for restraining abnormal transfer, and which ensure that the primer layer 105 is not liable to be dyed with the dye, for restraining the print density from being lowered.

Specific examples of such resin include polyester resins, polyacrylic ester resins, polyvinyl acetate resins, polyurethane resins, styrene-acrylate resins, polyacrylamide resins, polyamide resins, polyether resins, polystyrene resins, polyethylene resins, polypropylene resins, polyvinyl resins such as polyvinyl chloride resin, polyvinyl alcohol resin, polyvinylpyrrolidone resin, etc., and polyvinyl acetal resins such as polyvinyl acetoacetal, polyvinylbutyl acetal, etc.

The primer layer 105 is formed, for example, in the following manner. First, the resin is dissolved or dispersed in a predetermined solvent, to prepare a primer layer composition (liquid composition). Next, the composition is applied to the thermal transfer sheet substrate 101 by forming means such as a gravure printing method, a screen printing method, a reverse roll coating method using a gravure plate, etc., followed by drying. As a result, the primer layer 105 is formed. Besides, additives (such as a fluorescent brightener), filler or the like may be added to the primer layer composition (liquid composition), appropriately. The primer layer 105 is so applied as to have a thickness, on dry basis, of 0.01 to 2.0 g/m$^2$. Besides, the primer layer 105 may be formed by a method in which during the step of forming the thermal transfer sheet substrate 101, the composition is applied to the thermal transfer sheet substrate 101 before the thermal transfer sheet substrate 101 is oriented, and thereafter the composition layer is stretched (oriented) together with the thermal transfer sheet substrate 101.

Incidentally, while the case where the primer layer 105 for strengthening the adhesion of the thermal transfer sheet substrate 101 to the dye layer 107, the laminate layer 109 and the sensor mark layer 111 to be described later is formed on the face side of the thermal transfer sheet substrate 101 has been described above, the primer layer forming treatment may be replaced by one of various adhesion treatment. A known resin surface modifying technique such as corona discharge treatment, flame treatment, ozonizing treatment, ultraviolet treatment, radiation treatment, surface roughening treatment, chemical treatment, plasma treatment, low-temperature plasma treatment, grafting treatment, etc. may be applied directly as the adhesion treatment. Besides, two or more of the just-mentioned treatments may be used jointly, as the adhesion treatment.

[Dye Layer]

The dye layer 107 includes dye layers 107Y, 107M, and 107C which are sequentially formed on the primer layer 105. Each of the dye layers 107Y, 107M, and 107C contains a dye and a binder resin which supports the dye. Here, the dye layer 107 is a dye layer containing a dye having a yellow hue, the dye layer 107M is a dye layer containing a dye having a magenta hue, and the dye layer 107C is a dye layer containing a dye having a cyan hue. As the dyes added to the dye layers 107, any of those known dyes which are transferred through fusion, diffusion or sublimation by heat can be utilized.

Examples of such dyes include: diarylmethane dyes; triaryl methane dyes; thiazole dyes; merocyanine; methine dyes such as pyrazolonemethine dyes; indoaniline; azomethine dyes represented by acetophenoneazomethine, pyrazoloazomethine, imidazoleazomethine, imidazoazomethine, and pyridoneazomethine dyes; xanthene dyes; oxazine dyes; cyanostyrene dyes represented by dicyanostyrene and tricyanostyrene dyes; thiazine dyes; azine dyes; acridine dyes;

benzeneazo dyes; azo dyes such as pyridoneazo, thiopheneazo, isothiazoleazo, pyroleazo, pyrasoleazo, imidazoleazo, thiadiazoleazo, triazoleazo, and dis-azo dyes; spiropyran dyes; indolinospiropyran dyes; fluoran dyes; Rhodamine lactam dyes; naphthoquinone dyes; anthraquinone dyes; and quinophthalone dyes. Besides, the dye layers 107Y, 107M, and 107C may further contain other known dyes which are used for thermal transfer method, in addition to the above-mentioned dyes.

The dyes to be added to the dye layers 107Y, 107M, and 107C are determined taking into account such characteristics as the dye's hue, print density, light fastness, storage stability, solubility in binder resin, etc.

Besides, at least an indoaniline dye having the following structural formula (3) is added, as cyan dye, to the dye layer 107C according to the present embodiment.

(3)

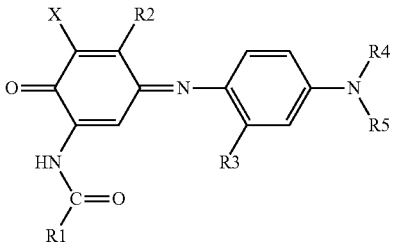

Here, in the above structural formula (3), the substituent groups R1, R2, R4 and R5 are each independently an alkyl group of one to three carbon atoms, R3 is hydrogen or an alkyl group of one to three carbon atoms, and X is hydrogen or chlorine.

Incidentally, as the mass ratio of the total amount of the dye(s) to the binder resin in each of the dye layers 107Y, 107M, and 107C, a value ordinarily applied for a dye layer of a thermal transfer sheet can be applied. For example, the total amount of the dye(s) may be 30 to 300 parts by mass based on 100 parts by mass of the binder resin, on a dry basis.

The binder resin constituting the dye layer 107 is not specifically restricted, and may be any of known binder resins which are used for dye layers. Examples of the known binder resins include cellulose resins such as cellulose addition compounds, cellulose esters, cellulose ethers, etc., polyvinyl acetal resins such as polyvinyl alcohol, polyvinyl formal, polyvinyl acetoacetal, polyvinyl butyral, etc., vinyl resins such as polyvinylpyrrolidone, polyvinyl acetate, polyacetic acid-polyvinyl chloride copolymer, polyacrylamide, styrene resins, poly(meth)acrylic esters, poly(meth)acrylic acid, (meth)acrylic acid copolymers, etc., rubber resins, ionomer resins, olefin resins, and polyester resins, among which particularly preferred are polyvinyl acetal resins.

The polyvinyl acetal resins are resins which are obtained by reacting a polyvinyl alcohol resin with an aldehyde, to effect acetallization. The aldehyde component is not specifically restricted; for example, acetoaldehyde, butylaldehyde and the like can be selected as the aldehyde component. In addition, the polyvinyl acetal resin may be a resin obtained by simultaneously bringing two or more aldehyde components to acetalization, or may has a mixture of two or more polyvinyl acetal resins.

Specific examples of the polyvinyl acetal resin which can be used here include S-LEC BL-S, S-LEC BX-1, S-LEC BX-5, S-LEC KS-1, S-LEC KS-3, S-LEC KS-5, and S-LEC KS-10 (all tradenames; produced by Sekisui Chemical Co., Ltd.), and DENKA BUTYRAL #5000-A, DENKA BUTYRAL #5000-D, DENKA BUTYRAL #6000-C, DENKA BUTYRAL #6000-EP, DENKA BUTYRAL #6000-CS, and DENKA BUTYRAL #6000-AS (all tradenames; produced by Denki Kagaku Kogyo K.K.).

The glass transition temperature of the polyvinyl acetal resin is preferably 60 to 110° C. If the glass transition temperature is below 60° C., blocking or dye recrystallization in the dye layer is accelerated during preservation, leading to lowered storage stability, which naturally is undesirable. On the other hand, when the glass transition temperature is above 110° C., dye release properties at the time of printing (recording) is lowered, which also is undesirable. Incidentally, the glass transition temperature can be measured, for example, by differential scanning calorimetry (DSC).

Examples of the other resin components that can be added to the dye layer 107 include: cellulose resins such as ethyl cellulose, hydroxyethyl cellulose, hydroxypropyl cellulose, methyl cellulose, cellulose acetate, cellulose acetate butyrate, etc.; vinyl resins such as polyvinyl acetate, vinyl chloride-vinyl acetate copolymer resin, styrene resin, polyvinylpyrrolidone, etc.; acrylic resins such as poly(meth)acrylates, poly(meth)acrylamides, etc.; polyurethane resins; polyamide resins; epoxy resin; and phenoxy resin. The above-mentioned resin components are not limitative, and still other resin components can also be added, appropriately, within such a range as not to spoil the effect of the present technology.

Besides, known various additives may be also added to the dye layer 107, if desirable. Examples of the additives include particulates of organic matter such as polyethylene wax, acrylics, silicones, benzoguanamine resins, etc., particles of inorganic matter such as calcium carbonate, silica, mica, etc., silicone resins, silicone oils, and phosphoric esters. Such additives are added to the dye layer 107 for the purpose of enhancing release properties relating to the transferred image receiving sheet 20 (described later) and application properties of the dyes.

Each of the dye layers 107Y, 107M, and 107C as above-mentioned is formed in the following manner. First, the dye, the binder resin and, optionally, desired additives are added to a predetermined solvent to dissolve or disperse the components, thereby preparing a dye layer composition (liquid composition). Next, the composition (liquid composition) is applied to the thermal transfer sheet substrate 101, followed by drying. As a result, each of the dye layers 107Y, 107M, and 107C is formed. As the application (coating) method, known means may be used, for example, a gravure printing method or a screen printing method. Other than these exemplary methods, a variety of application (coating) methods can also be used. The thickness of each of the dye layers 107Y, 107M, and 107C, on dry basis, is 0.1 to 6.0 g/m$^2$, preferably 0.2 to 3.0 g/m$^2$.

Incidentally, while the case where the dye layer 107 includes the dye layers 107Y, 107M, and 107C differing in hue has been described above, the dye layer 107 may include dye layers of a single hue.

[Laminate Layer]

The laminate layer 109 is a layer for protecting the images thermally transferred to the transferred image receiving sheet 20 which will be described later. In fact, if thermal transfer of dye-containing images to the transferred image receiving sheet 20 is only conducted, the dyes are left exposed at the surface of the transferred image receiving sheet 20, probably resulting in that the prints (the images formed of the dyes thermally transferred to the receiving layer 207 of the transferred image receiving sheet 20) are insufficient in light fastness, mar-proofness, chemical resistance, or the like. In view of this, after the dye-containing images are thermally transferred to the receiving layer 207 of the transferred image receiving sheet 20, at least part of the laminate layer 109 is thermally transferred onto the receiving layer 207 of the transferred image receiving sheet 20 to coat (cover) the prints, whereby a print protective layer having a transparent resin is formed on the prints, thereby protecting the transferred image receiving sheet 20.

As shown in FIG. 1, the laminate layer 109 according to the present embodiment includes a releasing layer 151 and a transferred image coating layer 153. When heated by heating means such as a thermal head, the transferred image coating layer 153 of the laminate layer 109 is released, and coats (covers) the images having been transferred onto the transferred image receiving sheet 20, to become a transparent resin layer (print protective layer) which protects the transferred images.

Here, the transferred image coating layer 153 according to the present embodiment includes a protective layer 155 and an adhesive layer 157, as shown in FIG. 1.

The releasing layer 151 is a layer which, when heated by heating means such as a thermal head, is left on the primer layer 105 and causes the transferred image coating layer 153 (the protective layer 155 and the adhesive layer 157) (described later) to be released from the thermal transfer sheet 10. The releasing layer 151 is composed, for example, of a wax such as silicone wax, etc., or a resin such as silicone resins, fluoro-resins, acrylic resins, water-soluble resins, cellulose derivative resins, urethane resins, vinyl acetate resins, polyvinyl acetal resins, acryl vinyl ether resins, maleic anhydride resins, etc., or a mixture thereof. As the resin constituting the releasing layer 151, a polyvinyl acetal resin or a cellulose derivative resin is preferably used, from the viewpoint of obtaining good recording characteristics.

The protective layer 155 constituting the transferred image coating layer 153 is a transparent resin layer which is thermally transferable, which is thermally transferred onto the dye-containing images (transferred to the transferred image receiving sheet 20) when heated by heating means such as a thermal head, and which functions as a print protective layer to protect the transferred image receiving sheet 20. While the protective layer 155 in the present embodiment is shown as a single layer in FIG. 1, the protective layer 155 may have a plurality of layers.

Examples of the resin which can be used to constitute the protective layer 155 include polyester resins, polystyrene resin, acrylic resins, polyurethane resin, acrylurethane resin, polycarbonate resins, epoxy-modified resins of these resins, silicone-modified resins of these resins, mixtures of these resins, ionizing radiation-curing resins, and ultraviolet-screening resins. Among these resins, preferred are polyester resins, polystyrene, acrylic resins, polycarbonate resins, and epoxy-modified resins. Among others, copolymers of at least one compound selected from the group composed of styrene, methyl methacrylate, ethyl methacrylate, vinyl chloride-vinyl acetate (vinyl chloride-vinyl acetate copolymer), vinyl chloride, cellulose ester derivatives are preferable because they have adhesion properties when non-transferred, they have release properties at the time of thermal transfer, and they have good luster. The most preferable are polystyrene resin and their modified products and copolymers, and acrylic resins and their modified products and copolymers.

The adhesive layer 157 constituting the transferred image coating layer 153 is a transparent resin layer which, when heated by heating means such as a thermal head, is thermally transferred onto the dye-containing images (having been transferred to the transferred image receiving sheet 20) together with the protective layer 155, to adhere the protective layer 155 to the transferred image receiving sheet 20. The resin constituting the adhesive layer 157 may be any of known resins in which a pressure sensitive adhesive, a heat-sensitive adhesive or the like is blended. Preferably, a thermoplastic resin having a glass transition temperature (Tg) of 30 to 80° C. is used. Examples of such a thermoplastic resin include polyester resins, vinyl chloride-vinyl acetate copolymer resin, acrylic resins, butyral resins, epoxy resins, polyamide resins, and vinyl chloride resin.

A compound having a predetermined structure is preferably added to the adhesive layer 157. Besides, an antioxidant, a ultraviolet absorber, a fluorescent whitener, organic filler, inorganic filler or the like may be added to the adhesive layer 157, appropriately, in addition to the compound having the predetermined structure. The compound having the predetermined structure will be described in detail later.

Thus, the laminate layer 109 according to the present embodiment has been described in detail above.

Incidentally, while the case where the laminate layer 109 has a three-layer structure of the releasing layer 151, the protective layer 155 and the adhesive layer 157 has been described in the present embodiment, the structure of the laminate layer 109 is not to be limited to the above-described example. The releasing layer 151 may not necessarily be formed, if the transferred image coating layer 153 including the protective layer 155 and the adhesive layer 157 can be easily released from the thermal transfer sheet 10 under heating by heating means such as a thermal head. Besides, a protective layer 155 functioning also as an adhesive layer 157 may solely be formed as the laminate layer 109, if the protective layer 155 can be easily released from the thermal transfer sheet 10 under heating by heating means such as a thermal head. In this case, the compound having the predetermined structure as will be described later is added to the protective layer 155 that functions also as the adhesive layer 157.

[Sensor Mark Layer]

The sensor mark layer 111 is provided for permitting a thermal transfer printer to recognize the positions of the dye layers 107 and the laminate layer 109.

Thus, referring to FIG. 1, the configuration of the thermal transfer sheet 10 according to the present embodiment has been described in detail above.

<Configuration of Transferred Image Receiving Sheet>

Figure 2:
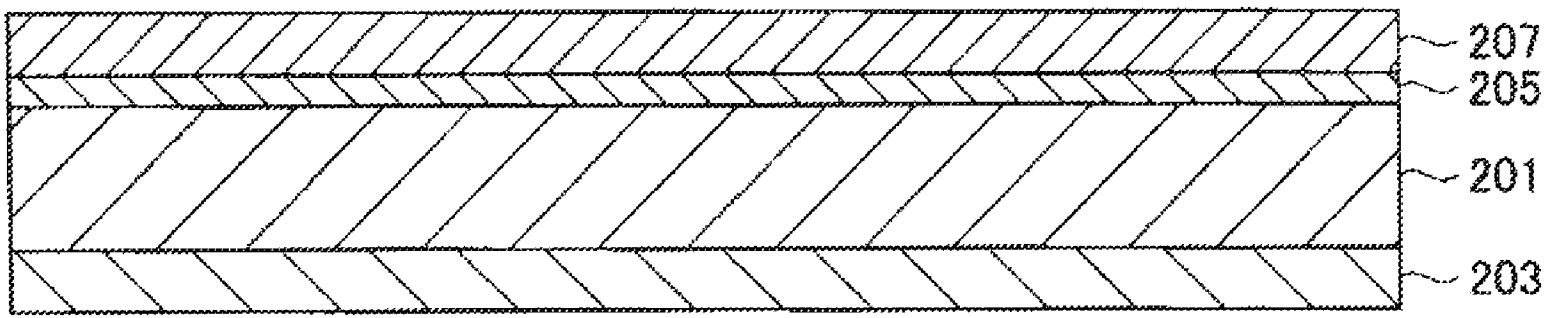
FIG. 2 is a sectional view of a transferred image receiving sheet according to an embodiment of the present technology.

Now, referring to FIG. 2, the configuration of the transferred image receiving sheet 20 according to the present embodiment will be described below. The transferred image receiving sheet 20 includes mainly a transferred image receiving sheet substrate 201, a back coat layer 203, an intermediate layer 205, and a receiving layer 207.

[Transferred Image Receiving Sheet Substrate]

The transferred image receiving sheet substrate 201 has the role of holding the receiving layer 207 which will be described later. In addition, the transferred image receiving sheet substrate 201 is heated at the time of thermal transfer, and, therefore, it preferably has a mechanical strength such that it can be handled without any trouble even when in a heated state.

The material constituting the transferred image receiving sheet substrate 201 is not specifically restricted, and may be any of known materials which are used as transferred image receiving sheet substrate. Examples of such a material include cellulose fiber papers such as capacitor tissue paper, glassine paper, vegetable parchment, or high-sizing paper, synthetic papers (based on polyolefin or polystyrene), wood-free paper, art paper, coat paper, cast coated paper, wall paper, lining paper, synthetic resin- or emulsion-impregnated paper, synthetic rubber latex-impregnated paper, synthetic resin internal sizing paper, paperboard, etc., and films of polyesters, polyacrylates, polycarbonates, polyurethane, polyimides, polyether-imides, cellulose derivatives, polyethylene, ethylene-vinyl acetate copolymer, polypropylene, polystyrene, acrylics, polyvinyl chloride, polyvinylidene chloride, polyvinyl alcohol, polyvinyl butyral, nylons, polyether-ether ketone, polysulfone, polyether-sulfone, tetrafluoroethylene, perfluoroalkyl vinyl ether, polyvinyl fluoride, tetrafluoroethylene-ethylene, tetrafluoroethylene-hexafluoropropylene, polychlorotrifluoroethylene, polyvinylidene fluoride, etc. Further, white opaque films formed by adding a white pigment or filler to these synthetic resins, and foamed sheets formed by expanding them, can also be used as the transferred image receiving sheet substrate 201.

In addition, laminates formed by arbitrarily combining a plurality of layers having the above-mentioned materials can also be used as the transferred image receiving sheet substrate 201. Representative examples of such laminate include a laminate of a cellulose fiber paper and a synthetic paper, and a laminate of a synthetic paper and a plastic film. The thickness of the transferred image receiving sheet substrate 201 can be set appropriately, and may be, for example, about 10 to 300 μm. Besides, a heat-insulating cushion layer having micropores may be provided on the transferred image receiving sheet substrate 201 by coating or the like.

[Back Coat Layer]

The back coat layer 203 is a layer which is provided, appropriately, on the back side of the transferred image receiving sheet substrate 201 for enhancing feedability of the transferred image receiving sheet 20 in a thermal transfer printer, and for preventing the transferred image receiving sheet 20 from curling.

Examples of the resin constituting the back coat layer 203 include acrylic resins, cellulose resins, polycarbonate resin, polyvinyl acetal resin, polyvinyl alcohol resin, polyamide resins, polystyrene resins, polyester resins, halogenated polymers, etc. containing, added as additive thereto, organic filler such as acrylic fillers, polyamide fillers, fluoro-fillers, polyethylene wax, etc. and inorganic filler such as silicon dioxide, metallic oxides, etc. Other than the just-mentioned resins, those resins obtained by curing the just-mentioned resins by use of a curing agent can also be utilized to constitute the back coat layer 203.

[Intermediate Layer]

The intermediate layer 205 is a layer which is appropriately provided between the transferred image receiving sheet substrate 201 and the receiving layer 207 which will be described later. The intermediate layer 205 may be a single layer, or may have a plurality of layers stacked on one another. Various functions such as the function of an adhesive layer (so-called anchor coat layer such as a primer layer) for adhesion between the transferred image receiving sheet substrate 201 and the receiving layer 207, the function of a barrier layer for protecting the transferred image receiving sheet substrate 201, the function of an antistatic layer for preventing electrification of the transferred image receiving sheet substrate 201, the function of a whitening layer, etc. are imparted, as desired, to the intermediate layer 205. Thus, the intermediate layer 205 according to the present embodiment means all the layers which are provided between the transferred image receiving sheet substrate 201 and the receiving layer 207; in this case, any of known layers can be included into the intermediate layer 205, as desired.

Examples of the resin constituting the intermediate layer 205 include those which are obtained by curing a thermoplastic resin, a thermosetting resin or a thermoplastic resin having a functional group, by use of any of various additives or other techniques. Specific examples include those resins which are obtained by curing polyvinyl alcohol, polyvinylpyrrolidone, polyester, chlorinated polypropylene, modified polyolefin, urethane resin, acrylic resin, polycarbonate, ionomer, or a monofunctional and/or multifunctional hydroxyl-containing prepolymer by isocyanate or the like. The intermediate layer 205 preferably has a thickness of about 0.5 to 30 g/m$^2$, on dry basis.

[Receiving Layer]

The receiving layer 207 is a layer to which the dyes contained in the dye layers formed on the thermal transfer sheet are thermally transferred, and it has a binder resin as a main ingredient. As the binder resin for forming the receiving layer 207, known resins can be utilized, among which preferred are those which can be easily dyed by the dyes.

Examples of the preferable resins include polyolefin resins such as polypropylene, etc., halogenated resins such as polyvinyl chloride, polyvinylidene chloride, etc., vinyl resins such as polyvinyl acetate, polyacrylate, polyvinyl butyral, polyvinyl acetal, etc., polyester resins such as polyethylene terephthalate, polybutylene terephthalate, etc., polystyrene resins such as polystyrene, polystyrene-acrylonitrile, etc., polyamide resins, phenoxy resin, copolymers of an olefin such as ethylene or propylene with other vinyl monomer, polyurethane, polycarbonate, acrylic resins, ionomers, and cellulose derivatives, which may be used either singly or as mixture thereof. Among these resins, preferred are acrylic resins, polyester resins, vinyl resins, polystyrene resins, and cellulose derivatives.

The receiving layer 207 preferably contains, added thereto, a release agent for the purpose of preventing the receiving layer 207 from fusing to the dye layer formed on the thermal transfer layer. Examples of the release agent which can be used here include phosphoric ester plasticizers, fluoro-compounds, and silicone oils (inclusive of reaction-curing silicones), among which preferred are silicone oils. Examples of the silicone oils include dimethylsilicone and other various modified silicones. Specific examples include amino-modified silicones, epoxy-modified silicones, alcohol-modified silicones, vinyl-modified silicones, and urethane-modified silicones. Further, materials obtained by blending these silicones or polymerizing these silicones by use of various reactions can also be used. These release agents may be used either singly or in combination of two or more of them.

Besides, the addition amount of the release agent is preferably 0.5 to 30 parts by mass based on 100 parts by mass of the binder resin constituting the receiving layer 207 (on dry basis). When the addition amount of the release agent is in the range of 0.5 to 30 parts by mass, fusing between the thermal transfer sheet and the receiving layer 207 of the transferred image receiving sheet 20, a lowering in the printing density, and the like troubles can be prevented from occurring. The release agent may not necessarily be added to the receiving layer 207; for example, the release agent may be contained in a releasing layer separately provided on the receiving layer 207.

Furthermore, the receiving layer 207 according to the present embodiment preferably contains, added thereto, a compound having a predetermined structure. Besides, an antioxidant, a UV absorber, a light stabilizer, organic filler, inorganic filler, a curing agent or the like may be added, as desired, to the receiving layer 207, in addition to the compound having the predetermined structure.

<Additive Compound>

Now, a compound having a predetermined structure which is added to at least either one of the adhesive layer 157 provided in the thermal transfer sheet 10 and the receiving layer 207 provided on the transferred image receiving sheet 20, according to the present embodiment, will be described in detail below. In the following description, the compound having the predetermined structure that is added to at least either one of the adhesive layer 157 and the receiving layer 207 will be referred to as "additive compound."

The additive compound according to the present embodiment is one or a plurality of compounds represented by the following structural formula (1) or (2):

(1)

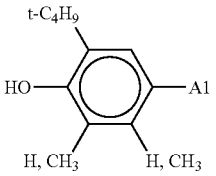

where A1 is an alkyl group substituted by at least one of a substituent group containing carboxylic acid ester and ether, an aryl and a thioether, or an aryl-substituted thiol group;

(2)

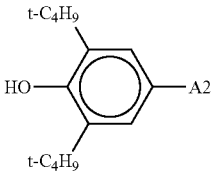

where A2 is a thioether-substituted alkyl group, a heterocyclic ring-substituted amino group, or an aryl-substituted thiol group.

More specifically, the additive compound in the present embodiment is preferably one or a plurality of compounds represented by any of the following structural formulas (1-1) to (2-3).

(1-1)

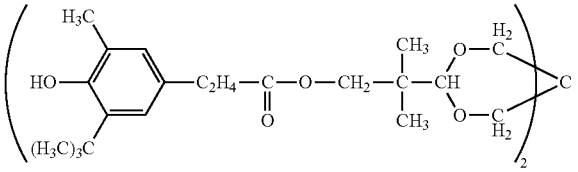

(1-2)

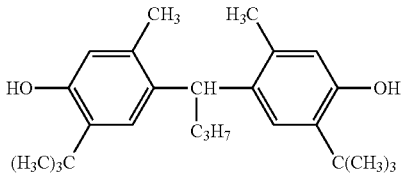

[Chemical 19]

-continued (1-3)

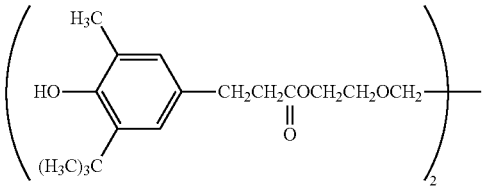

(1-4)

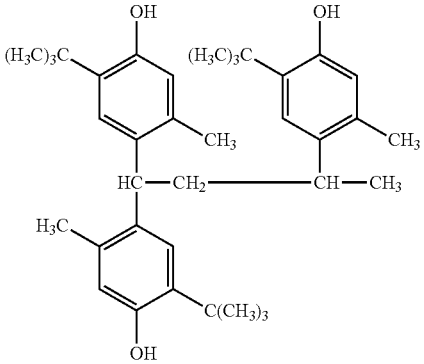

(1-5)

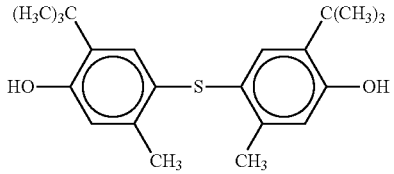

(1-6)

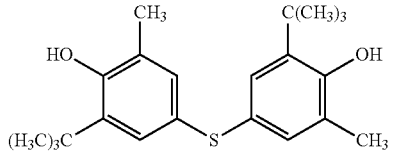

(1-7)

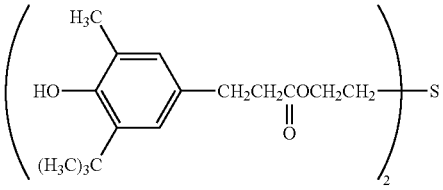

(2-1)

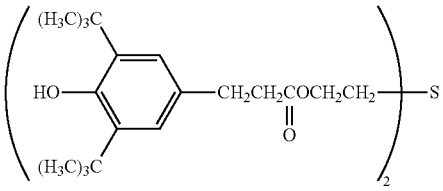

(2-2)

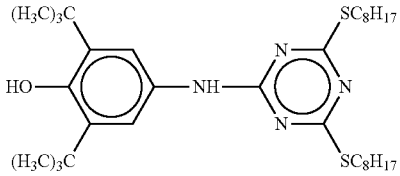

-continued (2-3)

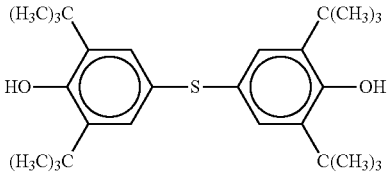

The content (addition amount) of the additive compound is 0.5 to 8 parts by mass, preferably 1 to 5 parts by mass, based on 100 parts by mass of the binder resin contained in the layer in which the additive compound is contained. Incidentally, the parts by mass is the parts by mass when the layer containing the additive compound added is dried (dry basis). If the addition amount of the additive compound is less than 0.5 parts by mass, a sufficient effect cannot be obtained, which naturally is undesirable. On the other hand, if the addition amount of the additive compound exceeds 8 parts by mass, a sufficient effect may be unobtainable, or such characteristics as dark-place storage stability and light fastness may be lowered, which also is undesirable.

Incidentally, in the case where a plurality of compounds are used in combination as the additive compound according to the present embodiment, the total mass of the additive compounds used in combination should satisfy the above-mentioned condition concerning the parts by mass.

The additive compound according to the present embodiment has been described in detail above.

Thus, in the present embodiment, the above-mentioned additive compound is added to at least either one of the adhesive layer 157 of the thermal transfer sheet 10 and the receiving layer 207 of the transferred image receiving sheet 20, which, in combination with the indoaniline dyes, makes it possible to form images showing excellent storage stability in dark place for a long time.

EXAMPLES

Examples and Comparative Examples

Now, the present technology will be described more specifically, showing Examples and Comparative Examples. Incidentally, in the following Examples and Comparative Examples, the expression "parts" or "%" is expressed by mass, unless specified otherwise.

In Examples of the present technology and Comparative Examples, a plurality of combinations of the thermal transfer sheet 10 and the transferred image receiving sheet 20 were produced while changing the structure of the indoaniline dye, the addition site of the additive compound, the structure of the additive compound, the parts by mass (dry basis) of the additive compound (Examples 1 to 17, Comparative Examples 1 to 10).

First, the methods of producing the thermal transfer sheet 10 and the transferred image receiving sheet 20, and the like will be shown below. Incidentally, in the following description, for each of the compositions (liquid compositions) used to produce the thermal transfer sheet 10 and the like, the materials constituting the composition and the parts by mass of the materials will be set forth. The parts by mass of each material indicates the parts by mass of the material, based on the total mass of the composition in which the material is contained.

<Production of Thermal Transfer Sheet>

First, as a thermal transfer sheet substrate 101, there was prepared a 4.5 μm-thick polyethylene terephthalate film (PET) (made by Mitsubishi Plastics, Inc.; K604E 4.5 W) of which the face side had been subjected to an adhesion treatment to form a primer layer 105. Next, the back side of the thermal transfer sheet substrate 101 was coated with a heat-resistant lubricant layer composition having the following formulation by gravure coating in such a manner that the coating weight after drying would be 1.0 g/m$^2$, followed by drying, to form a heat-resistant lubricant layer 103. The thermal transfer sheet substrate 101 formed with such a heat-resistant lubricant layer 103 was subjected to a heat curing treatment at 50° C. for five days.

Subsequently, a dye layer composition of the following formulation was applied by a #8 wire bar to the face side of the thermal transfer sheet substrate 101 in such a manner that the dry thickness would be 0.5 μm, followed by drying, to form a dye layer 107. The drying was conducted at 100° C. for 60 seconds. Besides, the indoaniline used as cyan dye was appropriately synthesized according to the synthesizing method described in Japanese Patent Laid-open No. 2008-248125.

To the face side of the thermal transfer sheet substrate 101 produced as above, a releasing layer composition of the following formulation was applied by gravure coating in such a manner that the dry thickness would be 0.3 μm, followed by drying, to form a releasing layer 151.

In addition, to the surface of the releasing layer 151, a protective layer composition of the following formulation was applied by a Baker Applicator (made by YOSHIMITSU SEIKI; Model YBA-5) in such a manner that the dry thickness would be 1 μm, followed by drying, to form a protective layer 155. The drying was conducted at 100° C. for 60 seconds.

Further, to the surface of the protective layer 155, an adhesive layer composition of the following formulation was applied by a Baker Applicator (made by YOSHIMITSU SEIKI; Model YBA-5) in such a manner that the dry thickness would be 1 μm, followed by drying, to form an adhesive layer 157. The drying was performed at 100° C. for 60 seconds. In this manner, a thermal transfer sheet 10 was formed.

Heat-Resistant Lubricant Layer Composition

| | |
|---|---|
| Polyvinyl acetal resin (Sekisui Chemical Co., Ltd.; S-LEC BX-1) | 3.0 parts |
| Polyisocyanate (Nippon Polyurethane Industry Co., Ltd.; CORONATE L) | 2.0 parts |
| Phosphoric ester (Dai-ichi Kogyo Seiyaku Co., Ltd.; PLYSURF A208S) | 1.0 part |
| Methyl ethyl ketone | 47.0 parts |
| Toluene | 47.0 parts |

Dye Layer Composition

| | |
|---|---|
| Indoaniline dye | 5 parts |
| Polyvinyl acetal resin (Denki Kagaku Kogyo K.K.; S-LEC BX-1) | 5 parts |
| Toluene | 45 parts |
| Methyl ethyl ketone | 45 parts |

Laminate Layer Releasing Layer Composition

| | |
|---|---|
| Polyvinyl acetal resin | 5 parts |
| (Sekisui Chemical Co., Ltd.; S-LEC BX-1) | |
| Toluene | 50 parts |
| Methyl ethyl ketone | 45 parts |

Laminate Layer Protective Layer Composition

| | |
|---|---|
| Polystyrene resin | 18 parts |
| (Mw = 100,000) | |
| Ultraviolet absorber | 2 parts |
| (Chiba Specialty Chemicals Inc.; TINUVIN320) | |
| Toluene | 80 parts |

Laminate Layer Adhesive Layer Composition

| | |
|---|---|
| Acrylic resin | 10 parts |
| (Methyl methacrylate/2-hydroxyethyl methacrylate/ phenoxyethyl methacrylate = 1/1/8, Mw = 20,000) | |
| Toluene | 45 parts |
| Methyl ethyl ketone | 45-x parts |
| Additive compound | x part(s) |

<Production of Transferred Image Receiving Sheet>

First, as a transferred image receiving sheet substrate 201, a synthetic paper FGS200 (thickness: 200 μm; Yupo Corporation) was prepared. To the face side of the transferred image receiving sheet substrate 201, the following receiving layer composition was applied by #14 wire bar in such a manner that the dry thickness would be 3 μm, followed by drying, to form a receiving layer 207. The drying was conducted at 100° C. for 60 seconds. After the drying, a heat curing was conducted at 45° C. for 48 hours. In this way, a transferred image receiving sheet 20 was formed. Incidentally, in Examples and Comparative Examples, formation of an intermediate layer 205 was omitted.

Receiving Layer Composition

| | |
|---|---|
| Acrylic resin | 18.5 parts |
| (Methyl methacrylate/2-hydroxyethyl methacrylate/ phenoxyethyl methacrylate = 1/1/8, Mw = 100,000 | |
| Carbinol-modified silicone oil | 0.5 part |
| (Dow Corning Toray Co., Ltd.; SF8427) | |

-continued

| | |
|---|---|
| Polyisocyanate | 1 part |
| (Nippon Polyurethane Industry Co., Ltd.; CORONATE L) | |
| Toluene | 40 parts |
| Methyl ethyl ketone | 40-y parts |
| Additive compound | y part(s) |

The configurations of the thermal transfer sheets 10 and the transferred image receiving sheets 20 produced in Examples and Comparative Examples, and the like, are set forth in Table 1 below. Incidentally, in Table 1, the structures of the indoaniline dyes are indicated according to classifications (3-1) to (3-3). The relations between these classifications and the actual structures are shown in Table 2 below. As shown in Table 1, for example in Example 1, the structure of the indoaniline dye was (3-2), while the additive compound was added to the receiving layer 207 of the transferred image receiving sheet 20 and has a structure represented by the structural formula (1-1). Besides, the parts by mass of the additive compound is 0.5.

Incidentally, in Comparative Examples 1 to 3, substances represented by the following structural formulas (5-1) to (5-3), respectively were used as the additive compound.

(5-1)

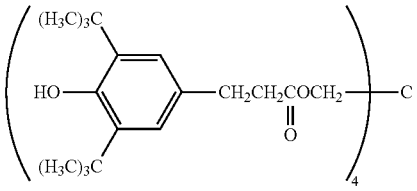

(5-2)

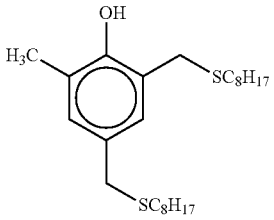

(5-3)

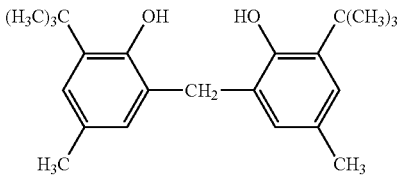

TABLE 1

| | No. | Structure of indoaniline dye | Additive compound: Addition site | Additive compound: Structure | Value of x | Value of y | Parts by mass, dry basis | Inclination |
|---|---|---|---|---|---|---|---|---|
| Ex. | 1 | (3-2) | Rec. | (1-1) | | 0.0925 | 0.5 | 0.13 |
| | 2 | | | | | 0.555 | 3 | 0.11 |
| | 3 | | | | | 1.48 | 8 | 0.14 |
| | 4 | | | (1-5) | | 0.555 | 3 | 0.08 |
| | 5 | | | (1-3) | | | | 0.12 |
| | 6 | | | (2-1) | | | | 0.14 |
| | 7 | | | (2-2) | | | | 0.11 |
| | 8 | | | (1-2) | | | | 0.13 |
| | 9 | (3-3) | Adh. | (1-5) | 0.05 | | 0.5 | 0.10 |
| | 10 | | | | 0.3 | | 3 | 0.09 |
| | 11 | | | | 0.8 | | 8 | 0.12 |
| | 12 | | | (1-1) | 0.3 | | 3 | 0.13 |
| | 13 | | | (1-3) | | | | 0.12 |
| | 14 | | | (2-1) | | | | 0.09 |
| | 15 | | | (2-2) | | | | 0.10 |
| | 16 | | | (1-2) | | | | 0.13 |
| | 17 | (3-1) | Rec. & Adh. | (2-1) | 0.37 | 0.2 | 2 | 0.13 |
| Comp. Ex. | 1 | (3-2) | Rec. | (5-1) | | 0.555 | 3 | 0.20 |
| | 2 | | | (5-2) | | 0.555 | | 0.33 |
| | 3 | (3-3) | Adh. | (5-3) | 0.3 | | | 0.57 |
| | 4 | (3-2) | | | | | | 0.23 |
| | 5 | (3-3) | | | | | | 0.18 |
| | 6 | (3-1) | | | | | | 0.23 |
| | 7 | (3-2) | Rec. | (1-1) | | 0.555 | 0.3 | 0.18 |
| | 8 | | | | | 1.85 | 10 | 0.21 |
| | 9 | (3-3) | Adh. | (1-5) | 0.03 | | 0.3 | 0.16 |
| | 10 | | | | 1 | | 10 | 0.17 |

Ex.: Example,
Comp. Ex.: Comparative Example
Rec.: Receiving layer;
Adh.: Adhesive layer

TABLE 2

| Structural formula of indoaniline dye | X | R1 | R2 | R3 | R4 | R5 |
|---|---|---|---|---|---|---|
| | | Substituent groups | | | | |
| (3-1) | H | $CH_3$ | $CH_3$ | $CH_3$ | $C_2H_5$ | $C_2H_5$ |
| (3-2) | Cl | $CH_3$ | $CH_3$ | $CH_3$ | $C_3H_7$ | $C_3H_7$ |
| (3-3) | Cl | $CH_3$ | $CH_3$ | H | $C_3H_7$ | $C_3H_7$ |

Incidentally, the additive compounds which are represented respectively by the structural formulas shown in Table 1 and which were used in Examples and Comparative Examples are as follows.

(1-1): Adeka Corporation; ADK STAB AO-80
(1-2): API Corporation; YOSHINOX BB
(1-3): BASF; IRGANOX 245
(1-4): Shipro Kasei Kaisha, Ltd.; SEENOX 336
(1-5): Shipro Kasei Kaisha, Ltd.; SEENOX BCS
(2-1): BASF; IRGANOX 1035
(2-2): BASF; IRGANOX 565
(5-1): BASF; IRGANOX 1010
(5-2): BASF; IRGANOX 1520L
(5-3): Shipro Kasei Kaisha, Ltd.; SEENOX 224M <Printing Method>

Each of the combinations of the thermal transfer sheet 10 and the transferred image receiving sheet 20 produced respectively in Examples 1 to 17 and Comparative Examples 1 to 10 were cut and pasted onto a genuine medium (made by Sony Corporation; UPS-R204) to form a sheet. The sheet was set on a printer (made by Sony Corporation; UP-DR200), and printing was conducted to print a pattern with 16 gradation levels. In this case, the thermal transfer sheet 10 was cut and pasted onto a cyan panel part and a laminate layer panel part of the genuine medium. In the process of this printing, the indoaniline dye contained in the dye layer 107 of the thermal transfer sheet was transferred to the receiving layer 207 of the transferred image receiving sheet 20. Thereafter, part of the laminate layer 109 (specifically, the protective layer 155 and the adhesive layer 157) was transferred onto the receiving layer 207. The printing was conducted in an environment of a temperature of 23° C. and a relative humidity of 60%.

<Evaluation>

The prints obtained by the printing were placed in a thermo-hygrostat (dark place) set to a temperature of 70° C. and a relative humidity of 50%, to be stored for 7 to 21 days, and a lowering in density at a portion corresponding to an OD (optical density) of about 1.0 was measured. The measurement was carried out by use of a colorimetric color difference meter (made by Gretag Macbeth; SPM100-II). The measured values were plotted against storage time (days), and the inclination of the rate of deterioration was determined. The results are collectively given in Table 1.

With respect to the results collectively shown in Table 1, Examples and Comparative Examples are compared with each other, for the corresponding examples in which the same indoaniline dye was used and the additive compound was added to the same site (the same component layer). Such a comparison shows that the inclination of the deterioration rate was smaller in Examples than in Comparative Examples. This verifies that when the additive compound according to the embodiment of the present technology is added to at least either one of the adhesive layer 157 of the thermal transfer sheet 10 and the receiving layer 207 of the transferred image receiving sheet 20, the storage stability of transferred dye images in dark place is enhanced.

As above-described, according to the embodiment of the present technology, the above-mentioned additive compound is added to at least either one of the adhesive layer 157 of the thermal transfer sheet 10 and the receiving layer 207 of the transferred image receiving sheet 20, whereby it is possible, in combination with the indoaniline dye, to form images showing excellent storage stability in dark place for a long time.

While the preferred embodiment of the present technology has been described in detail above, referring to the accompanying drawings, the present technology is not to be limited to the embodiment. It is clearly understood that those having common knowledge in the technical field to which the present technology pertains can get an idea of various modifications or changes within the scope of the technical thought as defined in the claims, and, therefore, such modifications and changes are to be embraced by the technical scope of the present technology.

The present disclosure contains subject matter related to that disclosed in Japanese Priority Patent Application JP 2010-248830 filed in the Japan Patent Office on Nov. 5, 2010, the entire content of which is hereby incorporated by reference.

What is claimed is:

1. A thermal transfer sheet comprising:

a dye layer which is provided on one side of a substrate and which contains an indoaniline dye; and a transferred image coating layer provided on that side of the substrate on which the dye layer is formed, the transferred image coating layer being operable to coat an image thermally transferred onto a transferred image receiving sheet, wherein the transferred image coating layer contains a compound having a predetermined structure and a binder resin, and the content of the compound having the predetermined structure is 0.5 to 8 parts by mass based on 100 parts by mass of the binder resin.

2. The thermal transfer sheet according to claim 1, wherein the compound having the predetermined structure is one or a plurality of compounds represented by the following structural formula (1) or (2):

(1)

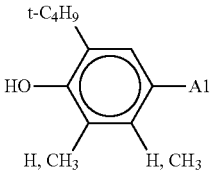

where A1 is an alkyl group substituted by at least one of a substituent group containing carboxylic acid ester and ether, an aryl and a thioether, or an aryl-substituted thiol group;

(2)

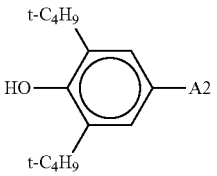

where A2 is a thioether-substituted alkyl group, a heterocyclic ring-substituted amino group, or an aryl-substituted thiol group.

3. The thermal transfer sheet according to claim 2, wherein the compound having the predetermined structure is one or a plurality of compounds represented by any of the following structural formulas (1-1) to (2-3):

(1-1)

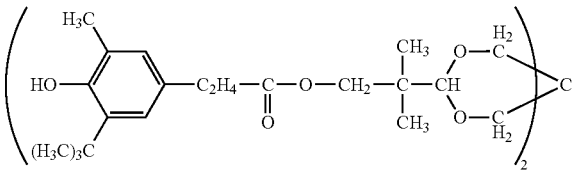

(1-2)

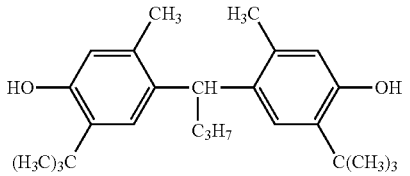

(1-3)

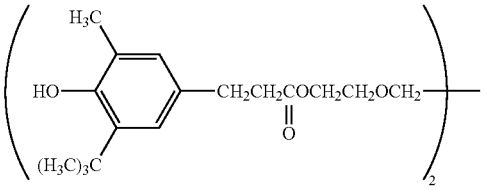

(1-4)

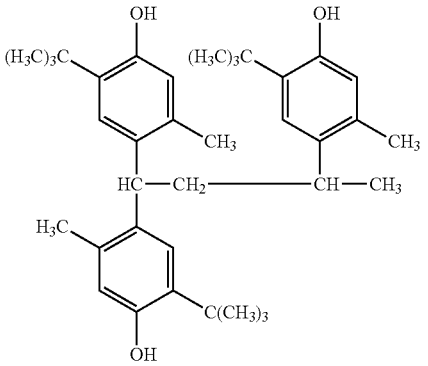

(1-5)

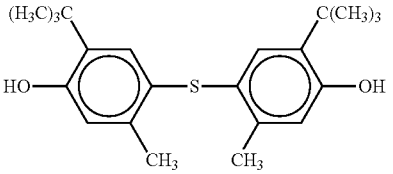

(1-6)

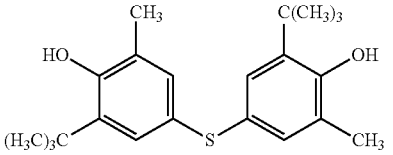

-continued (1-7)

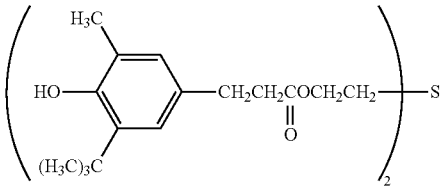

(2-1)

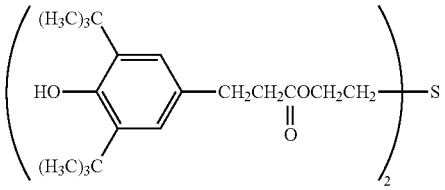

(2-2)

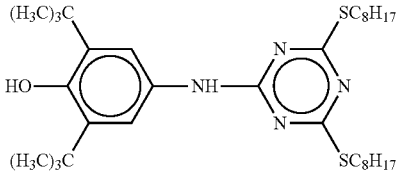

(2-3)

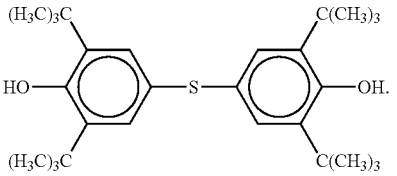

4. The thermal transfer sheet according to claim 1, wherein the indoaniline dye is a compound represented by the following structural formula (3):

(3)

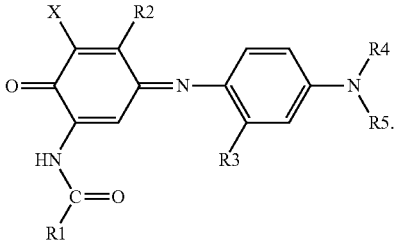

where the substituent groups R1, R2, R4 and R5 are each independently an alkyl group of one to three carbon atoms, R3 is hydrogen or an alkyl group of one to three carbon atoms, and X is hydrogen or chlorine.

5. A transferred image receiving sheet comprising:

a receiving layer to which an indoaniline dye is to be thermally transferred, wherein the receiving layer contains a compound having a predetermined structure and a binder resin, and the content of the compound having the predetermined structure is 0.5 to 8 parts by mass based on 100 parts by mass of the binder resin.

6. The transferred image receiving sheet according to claim 5, wherein the compound having the predetermined structure is one or a plurality of compounds represented by the following structural formula (1) or (2):

(1)

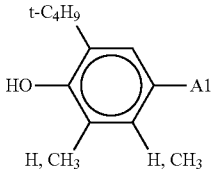

where A1 is an alkyl group substituted by at least one of a substituent group containing carboxylic acid ester and ether, an aryl and a thioether, or an aryl-substituted thiol group;

(2)

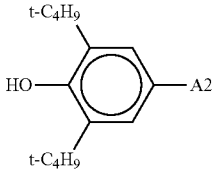

where A2 is a thioether-substituted alkyl group, a heterocyclic ring-substituted amino group, or an aryl-substituted thiol group.

7. The transferred image receiving sheet according to claim 6, wherein the compound having the predetermined structure is one or a plurality of compounds represented by any of the following structural formulas (1-1) to (2-3):

(1-1)

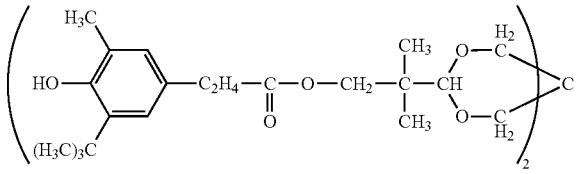

(1-2)

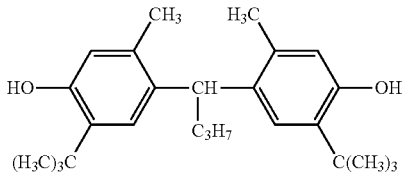

(1-3)

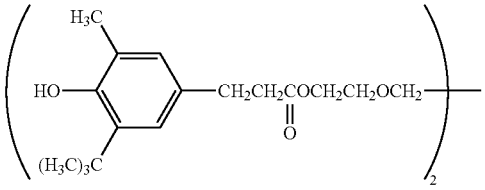

-continued (1-4)

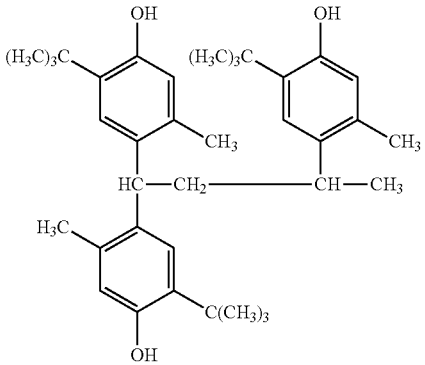

(1-5)

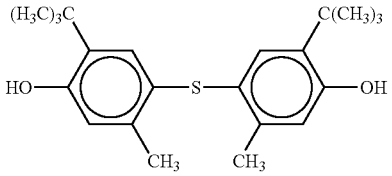

(1-6)

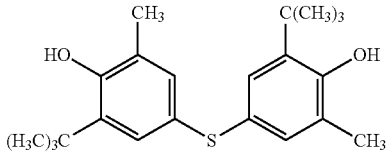

(1-7)

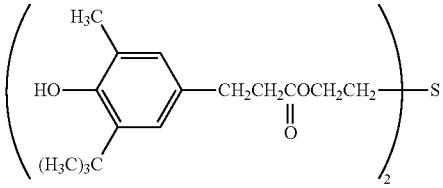

(2-1)

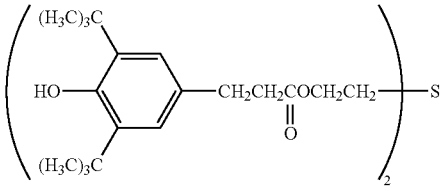

(2-2)

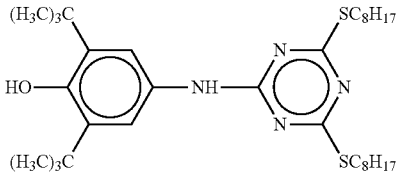

-continued (2-3)

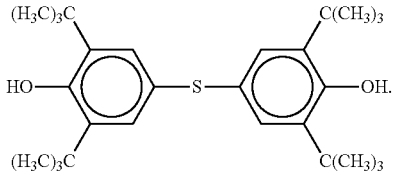

8. The transferred image receiving sheet according to claim 5, wherein the indoaniline dye is a compound represented by the following structural formula (3):

(3)

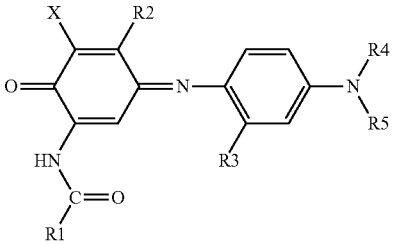

where the substituent groups R1, R2, R4 and R5 are each independently an alkyl group of one to three carbon atoms, R3 is hydrogen or an alkyl group of one to three carbon atoms, and X is hydrogen or chlorine.

9. A thermal transfer method comprising:

thermally transferring, from a thermal transfer sheet which includes a dye layer containing an indoaniline dye and a transferred image coating layer operable to coat an image thermally transferred to a transferred image receiving sheet, the indoaniline dye to a receiving layer of the transferred image receiving sheet; and thermally transferring the transferred image coating layer onto the receiving layer to which the indoaniline dye has been thermally transferred, wherein at least either one of the transferred image coating layer and the receiving layer contains a compound having a predetermined structure and a binder resin, and the content of the compound having the predetermined structure is 0.5 to 8 parts by mass based on 100 parts by mass of the binder resin.

* * * * *